US006557325B1

(12) United States Patent
Katz

(10) Patent No.: US 6,557,325 B1
(45) Date of Patent: May 6, 2003

(54) COMPUTER PACKING PILLOW AND METHOD

(75) Inventor: Edward R. Katz, Cartersville, GA (US)

(73) Assignee: Office Moving Systems, Inc., Cartersville, GA (US)

( * ) Notice: Subject to any disclaimer, the term of this patent is extended or adjusted under 35 U.S.C. 154(b) by 0 days.

(21) Appl. No.: 09/934,053

(22) Filed: Aug. 21, 2001

(51) Int. Cl.[7] ..... B65B 23/00

(52) U.S. Cl. ..... 53/472; 53/445; 53/474; 206/591; 206/593

(58) Field of Search ..... 53/474, 472, 445, 53/238; 206/522, 591, 593, 594; 493/464, 967, 904, 922, 93

(56) References Cited

U.S. PATENT DOCUMENTS 3,575,781 A * 4/1971 Pezely ..... 206/591
3,746,605 A 7/1973 Dillion et al.
3,769,145 A 10/1973 Gresham et al.
4,235,065 A * 11/1980 Freeman ..... 206/522
4,620,633 A * 11/1986 Lookholder ..... 206/523
4,826,329 A * 5/1989 Bellini ..... 190/103
5,274,846 A * 1/1994 Kolsky ..... 2/16
5,340,632 A * 8/1994 Chappuis ..... 363/132
5,491,017 A 2/1996 Todt
5,623,812 A 4/1997 Todt
5,755,329 A * 5/1998 Sadow ..... 206/320
5,819,942 A * 10/1998 Sadow ..... 206/522
6,038,834 A 3/2000 Haley
6,067,779 A * 5/2000 Weder ..... 206/584

* cited by examiner

*Primary Examiner*—Rinaldi I. Rada
*Assistant Examiner*—Paul Durand
(74) *Attorney, Agent, or Firm*—Thomas, Kayden, Horstemeyer & Risley, LLP

(57) ABSTRACT

The present invention provides a plastic computer packing pillow that is filled with two layers of bubble wrap with the bubbles in each layer facing each other for protecting computers during relocation. The computer component is placed on the middle of the plastic pillow with the ends of the pillow touching the sides of the computer component during movement.

8 Claims, 3 Drawing Sheets

COMPUTER PACKING PILLOW AND METHOD

FIELD OF THE INVENTION

The present invention relates to a computer packing pillow for protecting computer components during relocation and the method of using the pillow.

DESCRIPTION OF RELATED ART

Since virtually every office has a number of computers, these must be moved when the office is relocated. The normal method of moving a computer is to unhook the various components and wrap these with moving pads to protect the components during moving. Moving pads are satisfactory for protecting furniture from dents during moving, but are not very satisfactory in protecting sensitive electronic equipment such as computers as the moving pads are usually dusty and may have a static charge which can damage a central processing unit (CPU). The moving pads can be secured around the computers by tape. While the computer components can be wrapped in the bubble wrap, bubbles tend to burst from impact. This is expensive as the bubble wrap is usually damaged and is not reusable.

While computers could be protected by placing the components in wrap is usually damaged and is not reusable.

While computers could be protected by placing the components in boxes surrounded by STYROFOAM® (a foamed polystyrene) that is not a very practical suggestion because the original boxes of Styrofoam®, in which the computers were shipped are usually not saved by the purchaser.

It would be desirable to provide a simple and inexpensive way to protect computer components during relocation. It would be especially desirable to have a means of protection that could be reused many times.

PRIOR ART

U.S. Pat. No. 6,038,834 (Haley), issued on Mar. 21, 2000, discloses a method of protecting a roll of pressure-sensitive paper using bubble wrap and film. The bubble in the bubble wrap entraps air and cushions the roll of paper.

U.S. Pat. No. 5,623,812 (Todt), issued on Apr. 29, 1997, discloses a method of shrink wrapping articles with a shrink film outer layer and an inner layer of non-woven fabric. When heat is applied the shrink film shrinks around the article while the non-woven material forms bubbles to cushion the article. U.S. Pat. No. 5,491,017 (Todt), issued on Feb. 13, 1996, discloses a similar process using an outer shrink film and an inner non-woven fabric which aerates to form bubbles during heating.

U.S. Pat. No. 3,746,605 (Dillon et al.), which issued on Jul. 17, 1973, discloses a cushioning which has cellular protrusions on one side and an imperforate backing sheet on the open side of the cellular protrusions. A permeable backing sheet is placed between the backing sheet and the layer having the cellular protrusions to provide for air passage. U.S. Pat. No. 3,769,145 (Gresham et al), which issued on Oct. 30, 1973 discloses a similar cushioning material which is formed in multiple plies of thermal plastic sheet material bonded together.

SUMMARY OF THE INVENTION

It is an object of the present invention to provide a method of protecting computer components during relocation. It is a further object to provide a protection method which is both inexpensive and permits the protecting materials to be reused a number of times. It is another object to provide a method which is utilizes antistatic materials to prevent electronic harm to any central processing unit that is being transported.

The objects of this invention are achieved by providing a method for wrapping computer components with a cushioned plastic pillow containing two layers of bubble wrap with the bubbles facing each other enclosed by an anti-static material. The air is entrapped within and between the bubbles on the inside of the cushioned plastic pillow. It is essential that the cushioned plastic pillow be anti-static as static electricity can damage the electronics of the computer components, particularly the central processing unit (CPU). It is important that the plastic pillow be cushioned to aid in protecting the computer component. It is essential that the bubbles on the plastic bubble layers face each other, to provide the proper cushioning effect. If the flat surfaces of the bubble layers face each other abutting bubbles in effect form a balloon which tends to burst when subjected to pressure. The bursting of these bubbles reduces the cushioning effect. On the other hand if the layers are nested together, no cushioning effect is obtained.

The computer components are protected by the cushioned plastic pillow containing the two layers of bubble wrap with the bubbles facing each other by placing the component in the center of the pillow which is resting on a flat surface and pulling the ends of the pillow along the sides of the component. A cushioned plastic pillow can be draped over the front of the component as with a video display if desired. It is preferable not to use tape to hold the cushioned plastic pillows in place on the computer components as the tape may have static charge, unless anti-static tape is used. Placing the components close together will hold the plastic pillow in place. This approach will result in additional cushioning between the components as there will be two sections of plastic pillows between adjoining components.

Wrapping of the computer components with the cushioned plastic pillow can be accomplished on the shelf of a cart which can then be stretched wrapped with film to prevent the components from falling off the cart.

This same method of wrapping the computer components can be used in connection with packing the components in commercial bins or plastic tubs. Two layers of components can be stacked on top of each other with a plastic pillow interspersed between them.

These and other objects, features, and advantages of the present invention will become more apparent upon reading the following specification in conjunction with the accompanying drawing figures.

DETAILED DESCRIPTION OF THE PREFERRED EMBODIMENTS

The method of the present invention is intended to provide a way of protecting computer components from damage by shifting on moving carts or the bins during relocation. Among these computer components are central processing units (CPU), video monitors, keyboards, speakers and various kinds of peripheral equipment. It has been proven on numerous occasions that furniture pads provide little protection for computer components during moving. The pads also may have a static charge which may ruin the electronics of components, particularly the CPU. Furniture pads are frequently dusty and dirty which may introduce dust into the computer component which may damage certain parts such as fans and chips.

The method of the present invention basically uses an anti-static cushioned plastic pillow which contains two layers of bubble wrap with the bubbles facing each other for wrapping computer components and protecting them during relocation. It is important that the plastic pillow be anti-static so as not to damage the electronics of the computer components. The plastic pouch of the pillow should be six (6) mils in thickness so as to provide some cushioning effect itself. The bubbles can be of various sizes. It is preferably if the bubbles are approximately 1 inch in diameter. The pouch the pillow can be formed from the single piece of plastic material that is folded in the middle and heat sealed on one side and the bottom.

The bubble wrap can be made of plastic that is commercially available. The bubble wrap has a first side and a second side with the first side being generally smooth and the second side having raised bubbles. A large number of bubbles are provided on a sheet of bubble wrap. The bubbles can be of various sizes. It is preferable if the bubbles are one (1) inch in diameter. There may be two and one-half bubbles per square inch. The thickness of the bubbles can be varied to achieve the desired amount of cushioning. This of course will vary the volume of air entrapped by the bubbles.

The bubble wrap can be prepared of polyethylene, nylon, polyvinyl chloride, SARAN® (a vinylidene chloride polymer) and the like and blends thereof. The preferred bubble wrap is polyethylene with some nylon content as it is found to retain air better over time. It is not necessary that the bubble have anti-static characteristics.

If the sheet of plastic bubbles is folded so that the flat surfaces face each other, the bubbles will tend to burst when subjected to pressure which reduces the cushioning effect. If the flat surfaces of the bubble wrap face the inside the plastic bag, air chambers are formed which produce the cushioning effect. It has been found that the air chambers found between the bubble wrap and the plastic pillow are the right size for the cushioning effect and, not too large as to burst when subjected to pressure.

Figure 1:
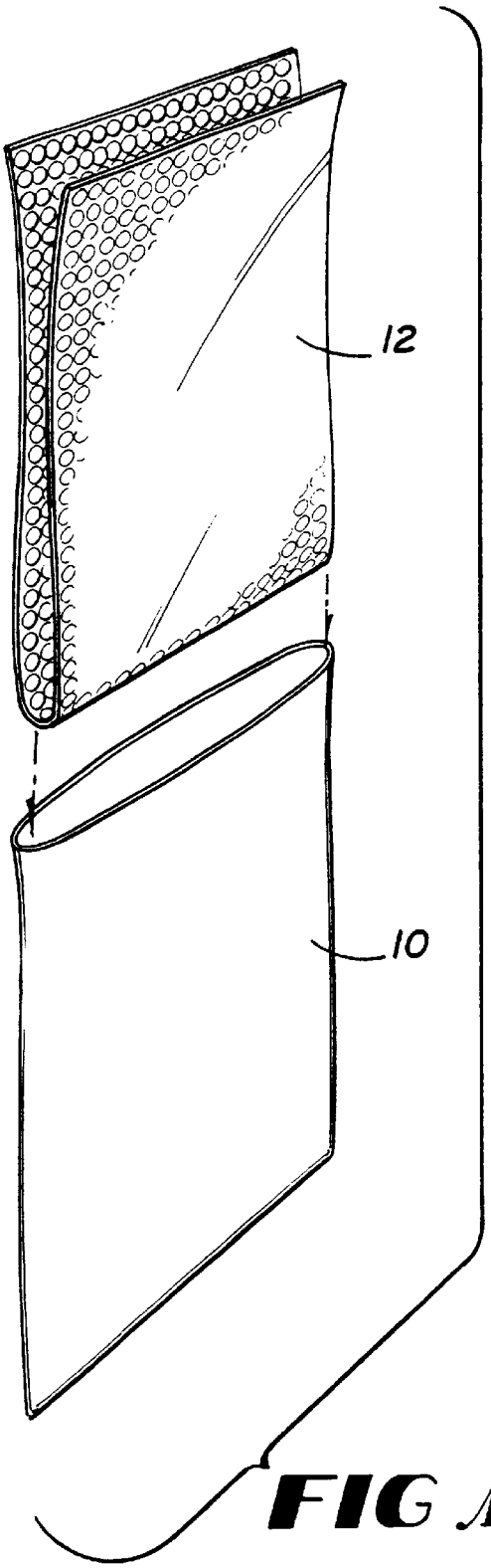
FIG. 1 is a perspective view of a folded sheet of bubble wrap in the process of being inserted into a plastic pouch.
Figure 2:
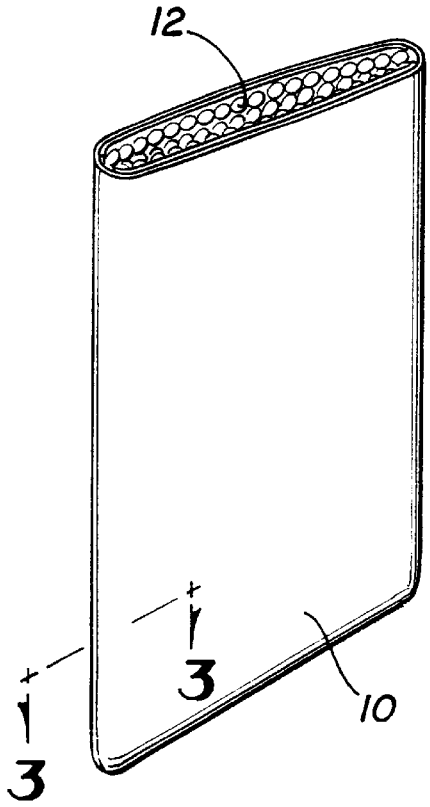
FIG. 2 is a perspective view of plastic pillow containing two layers of bubble wrap.
Figure 3:
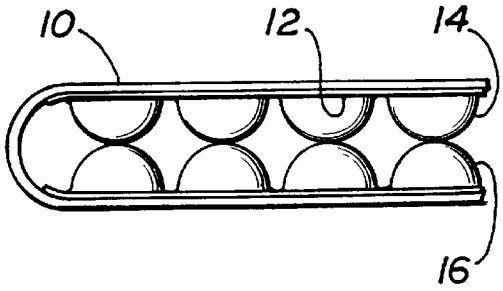
FIG. 3 is a cross section along lines 3—3 which shows the bubbles facing each other within the plastic wrap.

FIG. 1 shows plastic pouch 10 into which a folded sheet of bubble wrap 12 is being inserted. The bubble wrap is folded so that the bubbles face each other. The bubbles 14 and 16 face each a other as illustrated in FIG. 3. The plastic pouch 10 with the inserted bubble wrap 12 is shown in FIG. 2.

Figure 4:
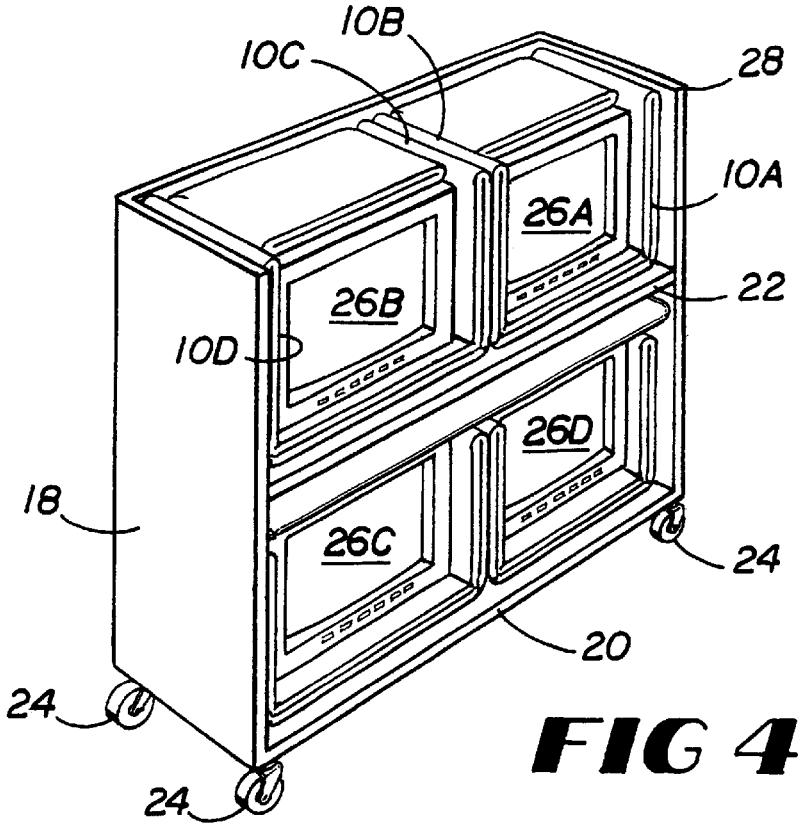
FIG. 4 is a perspective view of the moving cart with two shelves on which monitors have been placed in the middle of plastic pillows containing bubble wrap.
Figure 5:
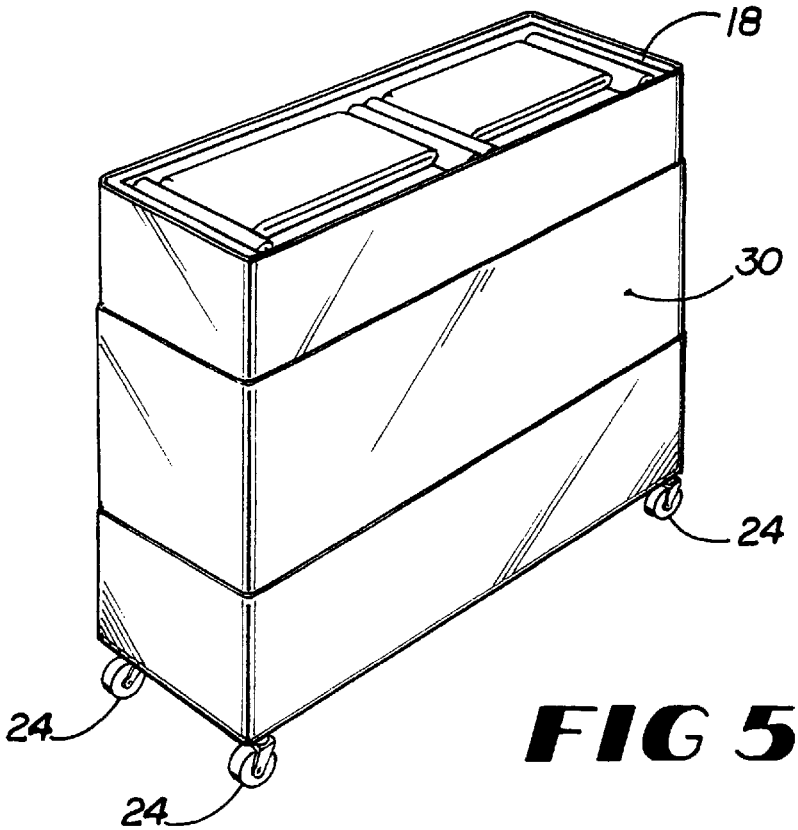
FIG. 5 is a perspective view of the moving cart of FIG. 4 which has been wrapped with several layers of plastic stretch film.

The computer components can be moved on a moving cart 18 as illustrated in FIG. 4. This cart may have one or more shelves 20 and 22 and may be rendered mobile by the use of castor wheels 24. This moving cart 18 can be loaded with computer components, such as video monitors 26 A–D. The plastic pillow 11 with the bubble wrap inside is first placed on the shelf 22 and the video monitor is placed on the middle of the plastic pillow and the plastic pillow is folded up along the sides of the video monitor, as shown in FIG. 4. One end 10A of the plastic pillow 11 can be placed against one end 28 of the moving cart 18 with the center of the plastic pillow being placed on the shelf 22. The video monitor 26*a* is then placed on the plastic pillow 11 while the other end of the plastic pillow 10*b* is wrapped along the side of the video monitor 26*a*. Similarly monitor 26*b* is placed in the center of the plastic pillow with the ends of the plastic pillows 10*c* and 10*d* being placed along the sides of the video monitor 26*b*. This results in two layers of plastic pillow 10*b* and 10*c* being between monitors 26*a* and 26*b*. The bottom shelf 20 is packed in the same way. It should be understood that any computer component can be packed on the moving cart 18 in this manner. The plastic pillow can be placed over the top of the video monitor and the screen on the front for extra protection (not shown). The loaded moving cart 18 can then be wrapped with several layers of stretch film 30 to further protect the computer components from damage and to prevent the computer components from falling off the moving cart 18. This stretch film can be either a low linear density polyethylene (LLDPE) or polyvinyl chloride (PVC) stretch film.

The computer packing pillows of this invention can be used to protect computer components in plastic bins or cardboard boxes during moving. A pillow can be placed on the bottom of the bin or box and a computer component placed on the top of the pillow. If the computer component is placed in the middle of the pillow, the pillow can be placed along the sides of the component as illustrated in FIG. 4 for moving cart. Two or more layers of components can be stacked on top of each other in plastic or cardboard box with packing pillows placed in between them. Once the plastic bins or boxes have been loaded, they can be placed on a dolly for moving.

The moving cart and plastic bins or box can be unpacked by removing the stretch film 30 and lifting the components out.

Figure 6:
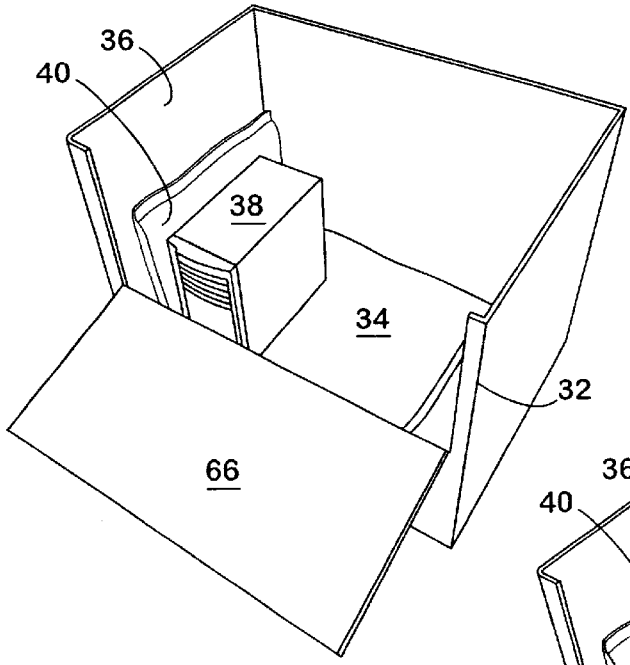
FIG. 6 is a perspective view of a box with one side partially cut away showing a Central Processing Unit (CPU). A plastic pillow has been placed in the bottom of the box which extends along one end of the box adjacent the CPU.
Figure 7:
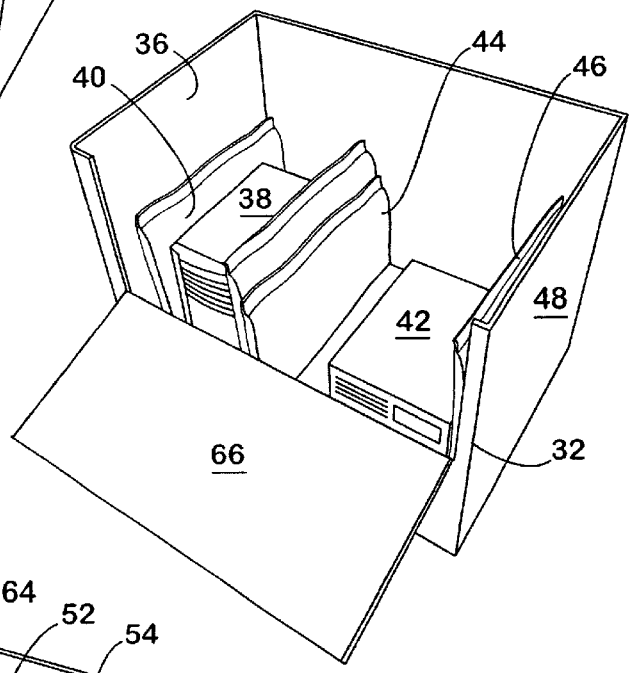
FIG. 7 is a perspective view of the box of FIG. 6 showing a second computer component having been placed in the box on a plastic pillow which also extends along the side of the computer component adjacent the other end of the box.
Figure 8:
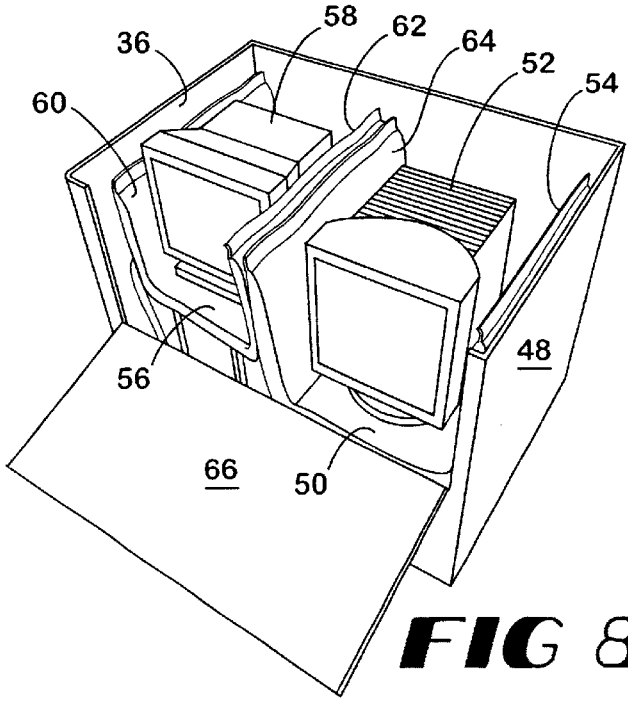
FIG. 8 is a perspective view of the box of FIG. 7 in which two video monitors have been placed on plastic pillows placed on top the computer components shown in FIG. 7. The pillows extend along all sides of the computer components which extend along the sides of video monitors.

FIG. 6 shows a box 32 in which a plastic pillow 34 contains a folded sheet of bubble wrap described above. The plastic pillow 34 is placed on the bottom of the box and along the end 36 of the box 32. A CPU 38 is placed adjacent to end 36 of the box 32. A portion of the plastic pillow 40 is placed between the CPU 38 and the end of the box 36 for cushioning effect. In FIG. 7 a second computer component 42 has been placed on another plastic pillow 44 which extends between CPU unit 38 and the computer component 42. A portion of the plastic pillow 46 extends up along wall 48 between the computer component 42 and the wall 48. In FIG. 8 a plastic pillow 50 has been placed upon the top of computer component 42 and a video monitor 52 placed on top thereof. A portion 54 of the plastic pillow 50 extends along end wall 48 between the end wall 42 and the video monitor 52. Similary another plastic pillow 56 has been placed on top of CPU unit 38 and the video monitor 58 placed in the middle of the plastic pillow 56. A portion of the plastic pillow 56 extends between the video monitor 58 and end wall 36 and another portion 62 extends along the side wall of video monitor 58. A portion 64 of plastic pillow 50 extends along the side of video monitor 52. Plastic pillows can be extended over the tops of video monitors 52 and 58 to finish the packing. Side wall 66 can be closed and sealed for transportation.

While the invention has been disclosed in its preferred forms, it will become apparent to those skilled in the art that many modifications, additions, and deletions can be made therein without departing from the spirit and scope of the invention and its equivalents as set forth in the following claims.

UNIQUE FEATURES OF THIS INVENTION

Plastic pillows of this invention have two layers of bubble wrap facing each other which provides substantial cushioning effect against damage that might done to computer components from settling or being bumped during moving. This cushioning effect is only obtained when two layers of bubble wrap are inserted into the pillow with the bubbles facing each other. Any other configuration of the plastic wrap provides very little cushioning effect.

The plastic pillows with the inserted bubble wrap can be used to protect the computer components during shifting and also placed along the sides of the component preventing the component from being damaged against the side of the moving cart or bin or against each other.

It is important that the plastic pillow be anti-static to prevent damaging of sensitive electronics of a computer component.

The computer packing pillows can be used to protect computer components in plastic bins or cardboard boxes. A pillow can be used on the bottom and a computer component placed on top. If the computer component is placed in the middle of the pillow, the pillow can be placed along the end of the bin or box. Five or more layers of components can be stacked on top of each other with a packing pillow placed in between them. The plastic bins or boxes can be placed on a dolly for moving.

What is claimed is:

1. A method for protecting computer components with sides and a top from physical and static damage during relocation, comprising the steps of:

a. providing at least one computer component;

b. supplying at least one sheet of bubble wrap, the bubble wrap having a first side and a second side, the first side being generally smooth and the second side having a plurality of bubbles thereon;

c. supplying an anti-static cushioning plastic pouch having ends;

d. folding the bubble wrap sheet into two layers so that the bubbles in said second side face each other;

e. inserting the folded bubble wrap sheet into the plastic pouch to form a plastic pillow; and f. securing each plastic pillow to the computer component so that it remains in proper position during relocation.

2. The method of claim 1 in which a plurality of computer components are placed in close proximity to each other so that the ends of the plastic pillow between adjoining computer components are secured to the sides of the adjoining components by the force exerted by said adjoining components.

3. The method of claim 1 in which a plurality of computer components are loaded into a moving cart with at least one shelf in which the securing (e) step of claim 1 involves:

a. first placing said plastic pillow with inserted bubble wrap on a shelf, said plastic pillow having a middle section and two ends, with at least the middle portion being placed on the shelf;

b. next placing computer component on the middle section of the plastic pillow;

c. next folding the ends of the plastic pillow along the sides of the computer component;

d. continue loading other computer components in close proximity to each other using steps (a) through (c) until the shelves are loaded to the desired extent;

e. in these steps securing the ends of the plastic pillows along the sides of the computer components for movement;

f. finally securing the computer components on the cart by wrapping the cart with stretch film; and g. after completion of the wrapping and securing steps, moving the cart to the new location and unpacking the computer components.

4. The method of claim 3 in which the plurality of computer components are placed in close proximity to each other so that the ends of the plastic pillows between adjoining computer components are secured to the sides of the adjoining components by the force exerted by said adjoining computer components.

5. The method for claim 1 in which a plurality of computer components are loaded into a moving box with a bottom which involves:

a. first placing said plastic pillow with the inserted bubble wrap on the bottom of the box, said plastic pillow having a middle section and two ends, with at least the middle section being placed on the bottom;

b. next placing a computer component on the middle section of the plastic pillow;

c. next folding the ends of the plastic pillow along the sides of the computer components;

d. continuing the loading of other components using steps (a) through (c) in the same way until the bottom of the moving box is loaded to the desired extent;

e. in these steps securing the ends of the plastic pillows along the sides of the computer components for movement;

f. after completion of the wrapping and securing steps, moving the box to the new location and unpacking the computer components.

6. The method of claim 5 in which the plurality of computer components are placed in close proximity to each other so that the ends of the plastic pillows between adjoining computer components are secured to the sides of the adjoining components by the force asserted by adjoining computer components.

7. The method of claim 5 in which at least one additional layer of a plurality of computer components is packed by the additional securing (e) step of claim 5 comprising;

a. placing said plastic pillow with the inserted bubble wrap on the top of a computer component which is located on the bottom of the box, said plastic pillow having a middle section and two ends, with at least the middle section being placed on the top of at least one computer component and any adjacent component;

b. next placing a computer component on the middle section of the plastic pillow;

c. next folding the ends of the plastic pillow along the sides of the computer component;

d. continuing the loading of other components using steps (a) through (c) until the moving box is loaded to desired extent; and e. in these steps securing the ends of the plastic pillows along the sides of the computer components for moving.

8. The method of claim 7 in which the plurality of the computer components are placed in close proximity to each other so that the ends of the plastic pillows between the adjoining components are secured to the sides of the adjoining components by the force exerted by said adjoining components.

* * * * *